US007111432B2

(12) United States Patent
Hansort

(10) Patent No.: US 7,111,432 B2
(45) Date of Patent: Sep. 26, 2006

(54) PASSTHROUGH CONCRETE ANCHOR

(75) Inventor: Rens Hansort, Napperville, IL (US)

(73) Assignee: Universal Form Clamp of Chicago, Inc., Bellwood, IL (US)

( * ) Notice: Subject to any disclaimer, the term of this patent is extended or adjusted under 35 U.S.C. 154(b) by 0 days.

(21) Appl. No.: 10/776,907

(22) Filed: Feb. 11, 2004

(65) Prior Publication Data

US 2004/0159070 A1 Aug. 19, 2004

Related U.S. Application Data

(63) Continuation-in-part of application No. 10/368,799, filed on Feb. 19, 2003, now abandoned.

(51) Int. Cl.
*E02D 35/00* (2006.01)
*E04G 21/14* (2006.01)
*E04H 12/34* (2006.01)

(52) U.S. Cl. ..... 52/125.4; 52/127.2; 52/698; 52/701; 52/704; 52/707

(58) Field of Classification Search ..... 52/711, 52/698, 125.4, 125.5, 125.2, 701, 124.2, 52/709, 712, 714, 715, 125.7, 127.2, 704, 52/707; 294/82.17, 82.19, 82.23, 89
See application file for complete search history.

(56) References Cited

U.S. PATENT DOCUMENTS

| | | | | |
|---|---|---|---|---|
| 0,958,978 | A | 5/1910 | Spencer | |
| 1,056,955 | A | 3/1913 | Stamm | |
| 1,123,107 | A | 12/1914 | Darr | |
| RE15,221 | E | 11/1921 | Megeniti | |
| 1,970,860 | A | 1/1934 | Lowell | |
| 1,984,211 | A | 12/1934 | Haase | |
| 2,163,446 | A | 6/1939 | Heckman | |
| 2,724,165 | A | 11/1955 | Williams | |
| 2,772,560 | A | 12/1956 | Neptune | |
| 2,886,370 | A * | 5/1959 | Liebert | 294/89 |
| 2,984,195 | A | 5/1961 | Duncan | |
| 3,297,293 | A | 1/1967 | Andrews et al. | |
| 3,499,676 | A | 3/1970 | Haeussler | |
| 3,652,118 | A | 3/1972 | Goldberg | |
| 3,861,106 | A | 1/1975 | Erhart | |
| 3,883,170 | A | 5/1975 | Fricker et al. | |
| 3,998,487 | A | 12/1976 | Biondo | |

(Continued)

FOREIGN PATENT DOCUMENTS

DE 1 684 278 6/1967

(Continued)

OTHER PUBLICATIONS

European Application No. 0568934 A2 Apr. 1993 Zambelli, Sergio.*

(Continued)

*Primary Examiner*—Daniel P. Stodola
*Assistant Examiner*—Nahid Amiri
(74) *Attorney, Agent, or Firm*—Jeffrey D. Peterson; Michael Best & Friedrich LLP

(57) ABSTRACT

A concrete anchor. The concrete anchor can be embedded within a concrete member to enhance lifting of the concrete member. The concrete anchor of the present invention can include a bar having a top, bottom and first and second sides, at least one attachment aperture, at least one reinforcement bar aperture, and at least one passthrough aperture. The concrete anchor can further include a projection positioned adjacent the second side of the bar. The projection can include an upwardly projecting top face, a downwardly projecting bottom face, a forwardly projecting front face and a rearwardly projecting rear face.

22 Claims, 12 Drawing Sheets

U.S. PATENT DOCUMENTS

| | | | | |
|---|---|---|---|---|
| 4,000,591 | A | | 1/1977 | Courtois |
| 4,087,947 | A | | 5/1978 | Turner |
| 4,173,367 | A | | 11/1979 | Haeussler |
| 4,173,856 | A | | 11/1979 | Fricker |
| 4,262,951 | A | | 4/1981 | Hoyer |
| 4,290,638 | A | | 9/1981 | Manning |
| 4,296,909 | A | | 10/1981 | Haeussler |
| 4,329,826 | A | | 5/1982 | Flogaus et al. |
| 4,367,892 | A | | 1/1983 | Holt |
| 4,368,914 | A | | 1/1983 | Truitt et al. |
| 4,383,674 | A | | 5/1983 | Fricker |
| 4,386,486 | A | | 6/1983 | Holt et al. |
| 4,398,762 | A | | 8/1983 | Haeussler et al. |
| D272,517 | S | | 2/1984 | Koehn |
| 4,437,642 | A | | 3/1984 | Holt |
| 4,466,569 | A | | 8/1984 | Taylor |
| 4,538,850 | A | | 9/1985 | De Vito |
| 4,580,378 | A | | 4/1986 | Kelly et al. |
| 4,603,522 | A | | 8/1986 | Johnson |
| 4,615,554 | A | | 10/1986 | Schilla et al. |
| 4,627,198 | A | | 12/1986 | Francies, III |
| 4,634,326 | A | | 1/1987 | Fischer |
| 4,655,015 | A | | 4/1987 | Hoyer |
| 4,671,554 | A | | 6/1987 | Lancelot |
| 4,702,045 | A | | 10/1987 | Fricker |
| 4,703,595 | A | | 11/1987 | Zipf et al. |
| 4,713,856 | A | | 12/1987 | Clausen |
| 4,726,562 | A | | 2/1988 | Courtois et al. |
| 4,769,960 | A | | 9/1988 | Zipf et al. |
| 4,807,843 | A | | 2/1989 | Courtois et al. |
| 4,821,994 | A | | 4/1989 | Fricker |
| 4,869,042 | A | | 9/1989 | Fricker |
| 4,930,269 | A | | 6/1990 | Kelly et al. |
| 4,947,613 | A | | 8/1990 | Fricker |
| 5,004,208 | A | | 4/1991 | Domizio |
| 5,014,473 | A | | 5/1991 | Kelly et al. |
| 5,042,219 | A | | 8/1991 | Fricker |
| 5,094,047 | A | | 3/1992 | Kelly et al. |
| 5,155,954 | A | | 10/1992 | Roire |
| 5,177,928 | A | | 1/1993 | Fricker |
| 5,226,265 | A | | 7/1993 | Kelly et al. |
| D344,836 | S | | 3/1994 | Huffman |
| D354,905 | S | | 1/1995 | Fitzmyers et al. |
| 5,396,743 | A | | 3/1995 | Bellette |
| 5,431,368 | A | | 7/1995 | Wilde |
| 5,456,052 | A | | 10/1995 | Anderson et al. |
| 5,469,675 | A | | 11/1995 | Arteon |
| 5,535,979 | A | | 7/1996 | Ellis-Callow |
| D374,394 | S | | 10/1996 | Lynch et al. |
| 5,588,263 | A | | 12/1996 | Kelly et al. |
| 5,596,846 | A | * | 1/1997 | Kelly ..... 52/125.2 |
| 5,651,911 | A | | 7/1997 | Pennypacker |
| D389,251 | S | * | 1/1998 | Kelly ..... D25/133 |
| D392,752 | S | * | 3/1998 | Kelly et al. ..... D25/133 |
| 5,809,703 | A | | 9/1998 | Kelly |
| 5,816,008 | A | | 10/1998 | Hohmann |
| 5,852,907 | A | | 12/1998 | Tobin et al. |
| 5,857,296 | A | * | 1/1999 | Niday et al. ..... 52/125.1 |
| 5,884,438 | A | | 3/1999 | Westhoff et al. |
| 5,987,830 | A | | 11/1999 | Worley |
| D422,894 | S | | 4/2000 | Kubica |
| 6,082,700 | A | | 7/2000 | Lancelot, III et al. |
| 6,092,849 | A | | 7/2000 | Zambelli et al. |
| 6,119,431 | A | | 9/2000 | Wakai |
| 6,131,976 | A | | 10/2000 | Silva |
| D437,063 | S | | 1/2001 | Lancelot, III et al. |
| D438,649 | S | | 3/2001 | Lancelot et al. |
| D438,991 | S | | 3/2001 | Lancelot, III et al. |
| 6,233,883 | B1 | | 5/2001 | Artdon |
| 6,260,900 | B1 | | 7/2001 | Scott |
| 6,341,452 | B1 | | 1/2002 | Bollinghaus |
| 6,343,444 | B1 | | 2/2002 | Minami |
| 6,460,824 | B1 | | 10/2002 | Lancelot, III et al. |
| 6,550,834 | B1 | | 4/2003 | Fromelius |
| 6,581,996 | B1 | * | 6/2003 | Fromelius ..... 294/89 |
| 6,647,674 | B1 | * | 11/2003 | Lancelot et al. ..... 52/125.4 |
| 6,694,680 | B1 | | 2/2004 | Zambelli et al. |
| 6,729,079 | B1 | * | 5/2004 | Francies et al. ..... 52/125.4 |
| 6,789,365 | B1 | | 9/2004 | Hohmann et al. |
| 2003/0213206 | A1 | | 11/2003 | Hansort |

FOREIGN PATENT DOCUMENTS

| | | |
|---|---|---|
| DE | 1 800 807 | 10/1968 |
| DE | 2 223 519 | 5/1972 |
| DE | 2 610 195 | 3/1976 |
| DE | 3 515 894 | 11/1986 |
| EP | 0 568 934 A2 | 4/1993 |
| EP | 634531 A1 | 4/1994 |
| FR | 2 586 442 | 8/1985 |
| GB | 408235 | 9/1932 |
| IT | 269410 | 11/1929 |

OTHER PUBLICATIONS

Dayton Superior, Precast-Prestressed Concrete Handbook, 1986, 6 pages.

Dayton Superior, Tilt-up Construction Handbook, 1990, 10 pages.

* cited by examiner

PASSTHROUGH CONCRETE ANCHOR

RELATED APPLICATIONS

This is a continuation-in-part of U.S. patent application Ser. No. 10/368,799, filed Feb. 19, 2003 now abandoned.

The present invention relates towards a concrete anchor assembly for embedment in a concrete member, such as a precast or tilt-up wall. The concrete anchor of the present invention allows for concrete members, such as walls, to be positioned by the use of standard lifting equipment (cranes with cable attachments, etc.) by connecting lifting attachments to the concrete anchor which is embedded in a concrete member.

BACKGROUND OF THE INVENTION

At present, concrete anchors are stamped out of strip steel. Reinforcing bars for anchoring and bonding are placed through the holes or notches in the anchor and shear plates are strongly welded to the anchors when the anchors are made. Lifting hardware is connected to the top of the anchor.

Prior art anchors need a separate pin, cut out, or plate welded on the bottom to develop a shear-cone in the concrete to develop holding strength. The strength of currently manufactured anchors are commonly 2-ton, 4-ton and 8-ton with a 4:1 safety factor. Current anchors are high in weight partially because only the connecting apertures are stamped out of the metal anchor, with the rest of the anchor remaining as solid material.

SUMMARY OF INVENTION

The present invention is directed towards a concrete lift anchor. The concrete anchor is made by drop forging or casting a unitary metal plate, suitably using a 90000 psi steel that brings the anchor to a 3-ton, 6-ton, or 10-ton capacity with a 4:1 safety factor. Anchors of increasing thickness allow for a greater weight capacity to be achieved.

The concrete lift anchor of the present invention comprises a metal bar having a top, bottom and first and second sides, at least one attachment aperture, at least one reinforcement bar aperture, at least one passthrough aperture, and a shear plate aperture. The top side of the bar further comprises a first channel, a first upwardly projecting face, a platform face, a second upwardly projecting face, and a second channel. The anchor further comprises a crescent shaped indentation on the first side of the rectangular shaped bar. The crescent shaped indentation allows for a reinforcement bar to be positioned within the indentation.

The reinforcement bar apertures, shear plate aperture, and passthrough apertures are formed in the anchor when forged or casted. The passthrough apertures of the anchor are suitably designed to save at least about 30% in the weight of the anchor, over a similarly or identically designed anchor without the passthrough apertures. This design makes the cost of transportation and surface treatment more economical because of the savings based on the reduced weight of the anchor. The passthrough apertures also provide additional strength by allowing the concrete to fill in the spaces during pouring. By forming the shear plate aperture in the anchor, it is not necessary to strongly weld the shear-plate to the anchor when the anchor is forged. The anchor of the present invention is designed so an individual can simply slide a shear plate or plates through the shear plate aperture and secure them in place. Suitable means of securing the shear plates would be either by a tack weld or by use of wedges that are pushed in from opposite sides and locked by a driving force, such as a hammer blow. The anchor of the present invention, therefore, allows for the opportunity to assemble the shear plate of the concrete anchor at the job site or precast manufacturer.

In one embodiment of the invention, the anchor comprises a rectangular shaped bar. In this embodiment, the rectangular shaped bar has a top, bottom and first and second sides, at least one attachment aperture, at least one reinforcement bar aperture, at least one passthrough aperture, and a shear plate aperture. The top side of the bar further comprises a first channel, a first upwardly projecting face, a platform face, a second upwardly projecting face, and a second channel. The second side of the rectangular shaped bar further comprises a downwardly projecting side face, an extending side face, and an upwardly projecting side face. The shear plate aperture is adjacent to the extending side face. A crescent shaped indentation is positioned on the first side of the rectangular shaped bar. Also, a wedged shaped foot is positioned on the bottom of the rectangular shaped bar. The wedged shaped foot is also formed in the drop forging or casting of the anchor. The wedged shaped foot of the present invention develops a larger shear-cone in the concrete than existing cutouts or pins.

In another embodiment of the concrete anchor of the invention, the anchor comprises a square shaped bar. In this embodiment, the square shaped bar has a top, bottom and first and second sides, at least one attachment aperture, at least one reinforcement bar aperture, at least one passthrough aperture, and a shear plate aperture. The top side of the bar further comprises a first channel, a first upwardly projecting face, a platform face, a second upwardly projecting face, and a second channel. The anchor further comprises a crescent shaped indentation on the first side of the square shaped bar. The shear plate aperture is found on the bar adjacent to the second side.

In another embodiment of the concrete anchor of the invention, the anchor comprises a bar having a top, bottom and first and second sides, at least one attachment aperture, at least one reinforcement bar aperture, and at least one passthrough aperture. The anchor further comprises a projection positioned adjacent the second side of the bar. The projection comprises an upwardly projecting top face, a downwardly projecting bottom face, a forwardly projecting front face and a rearwardly projecting rear face.

Other features and advantages of the invention will become apparent to those skilled in the art upon review of the following detailed description and drawings.

Figure 1:
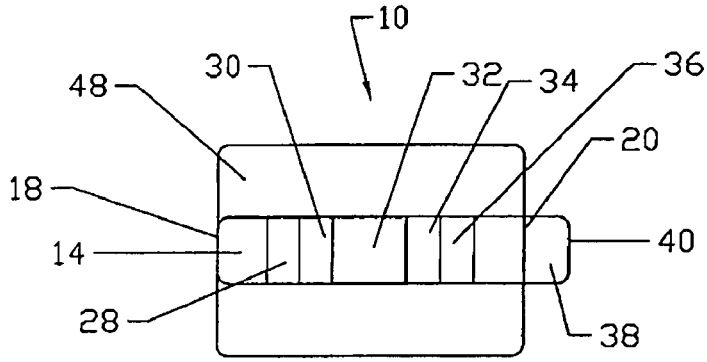
FIG. 1 shows a top view of one embodiment of the concrete lift anchor of the present invention.
Figure 2:
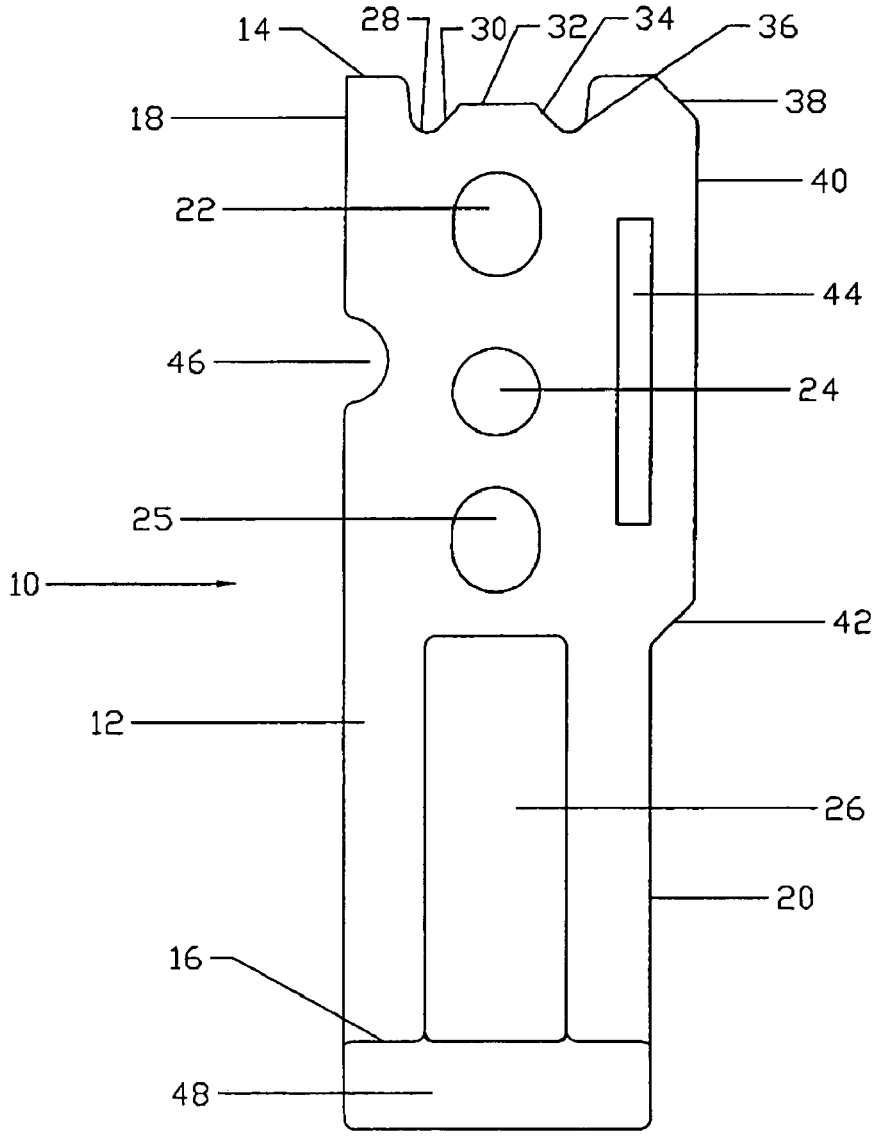
FIG. 2 shows a front view of the concrete lift anchor of FIG. 1.
Figure 3:
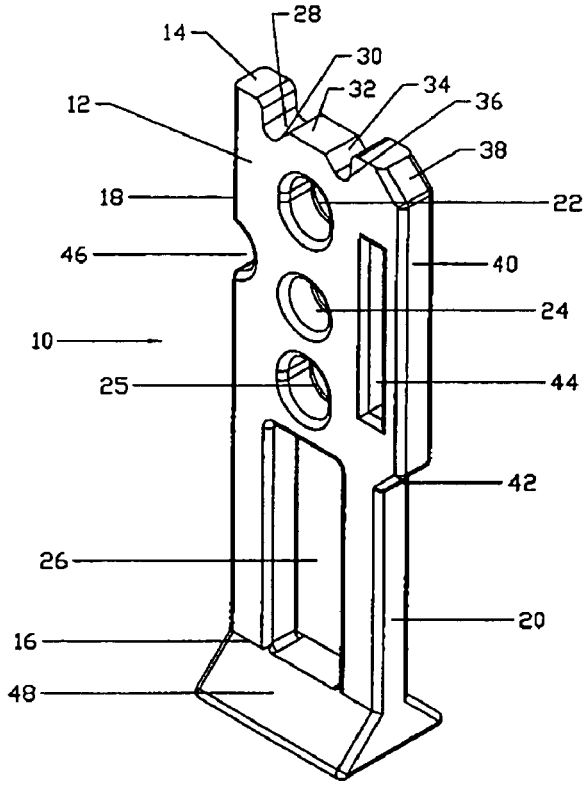
FIG. 3 shows a perspective view of the concrete lift anchor of FIG. 1.

Before the embodiments of the invention are explained in detail, it is to be understood that the invention is not limited in its application to the details of construction and/or the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof, as well as additional items and equivalents thereof.

DETAILED DESCRIPTION OF THE INVENTION

The present invention is directed towards a concrete lift anchor. The concrete anchor is made by drop forging or casting a unitary metal plate, suitably using a 90000 psi steel. Anchors of increasing thickness allow for a greater weight capacity to be achieved.

One embodiment of the concrete lift anchor of the present invention is shown in FIGS. 1–4.

The anchor 10 comprises a rectangular shaped bar 12 suitably constructed out of a durable metal such as steel. The anchor 10 is constructed by drop forging or casting as a unitary piece. The rectangular shaped bar has a top 14, bottom 16 and first 18 and second 20 sides, an attachment aperture 22, a first reinforcement bar aperture 24, a second reinforcement bar aperture 25 and a first passthrough aperture 26.

Suitably, the first passthrough aperture 26 is designed so that the weight of the anchor 10 is reduced by at least 30%. The reinforcement bar apertures 24 and 25 are suitably designed to allow for reinforcement bars in a concrete form to be passed through the apertures 24 and 25 respectively.

The top side 14 of the bar 12 further comprises a first channel 28, a first upwardly projecting face 30, a platform face 32, a second upwardly projecting face 34, and a second channel 36. The platform face 32, along with the lifting attachment aperture 22, is suitably designed to allow for the secure attachment of a lifting mechanism for moving and positioning a concrete form in which the concrete anchor 10 is embedded. The lifting attachment (such as a hook or other suitable attachment) is suitably connected to the concrete anchor 10 via the attachment aperture 22.

The second side 20 of the rectangular shaped bar 12 further comprises a downwardly projecting side face 38, an extending side face 40, and an upwardly projecting side face 42. A shear plate aperture 44 is adjacent to the extending side face 40. The shear plate aperture 44 is designed to receive a shear plate or plates 102. The shear plates 102 are suitably held in place either by a tack weld or by use of wedges that are pushed in from opposite sides and locked by driving them in by force. A crescent shaped indentation 46 is positioned on the first side 18 of the rectangular shaped bar 12. The crescent shaped indentation 46 allows for a reinforcement bar to be positioned within the indentation. Also, a wedged shaped foot 48 is located on the bottom 16 of the rectangular shaped bar 12.

Figure 5:
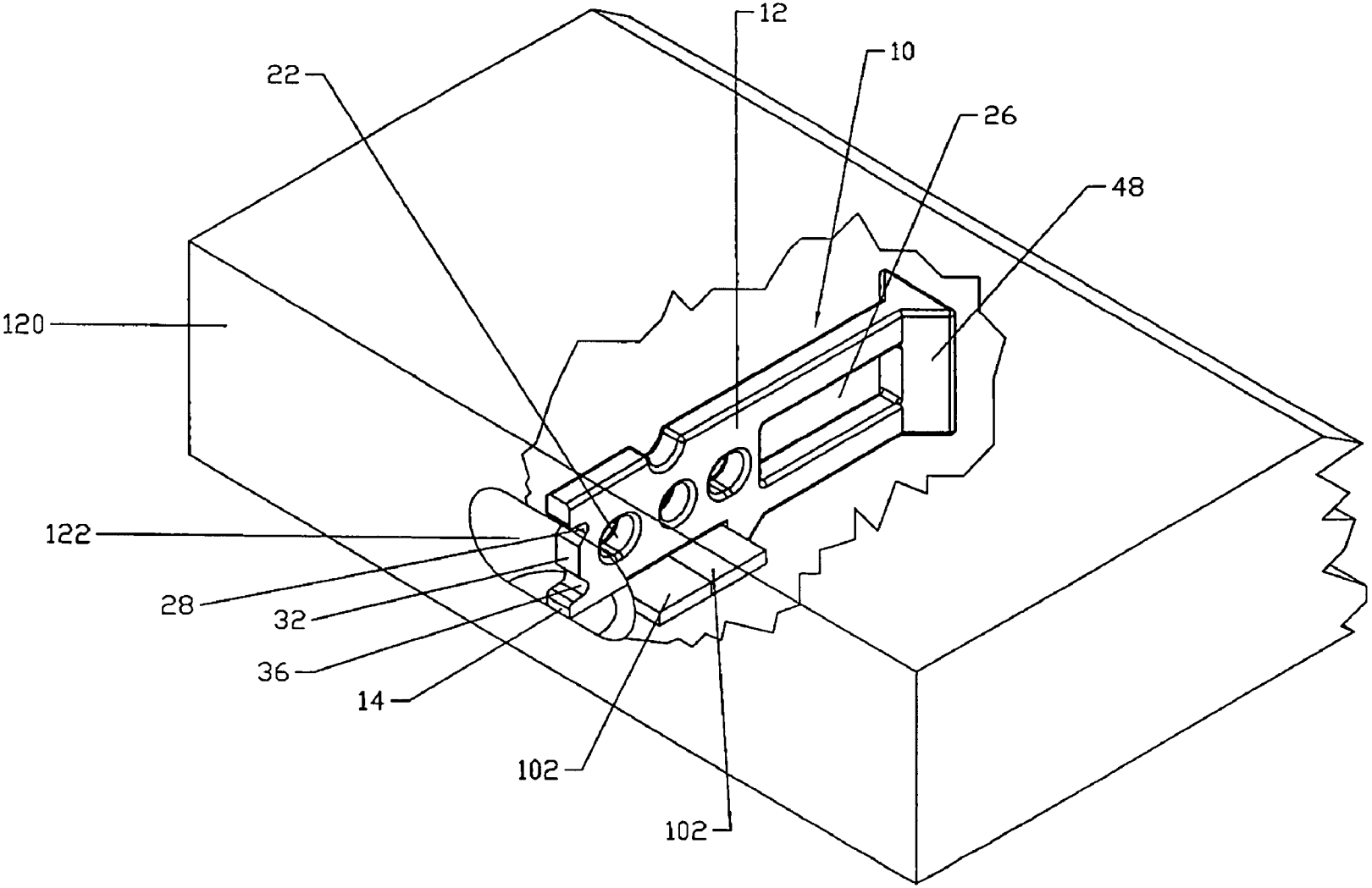
FIG. 5 shows a cut-away perspective view of the concrete lift anchor of FIG. 1 embedded in a concrete form.
Figure 6:
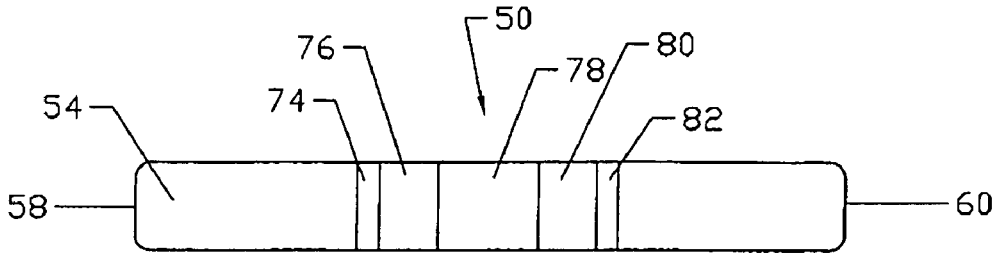
FIG. 6 shows a top view of another embodiment of the concrete lift anchor of the present invention.
Figure 7:
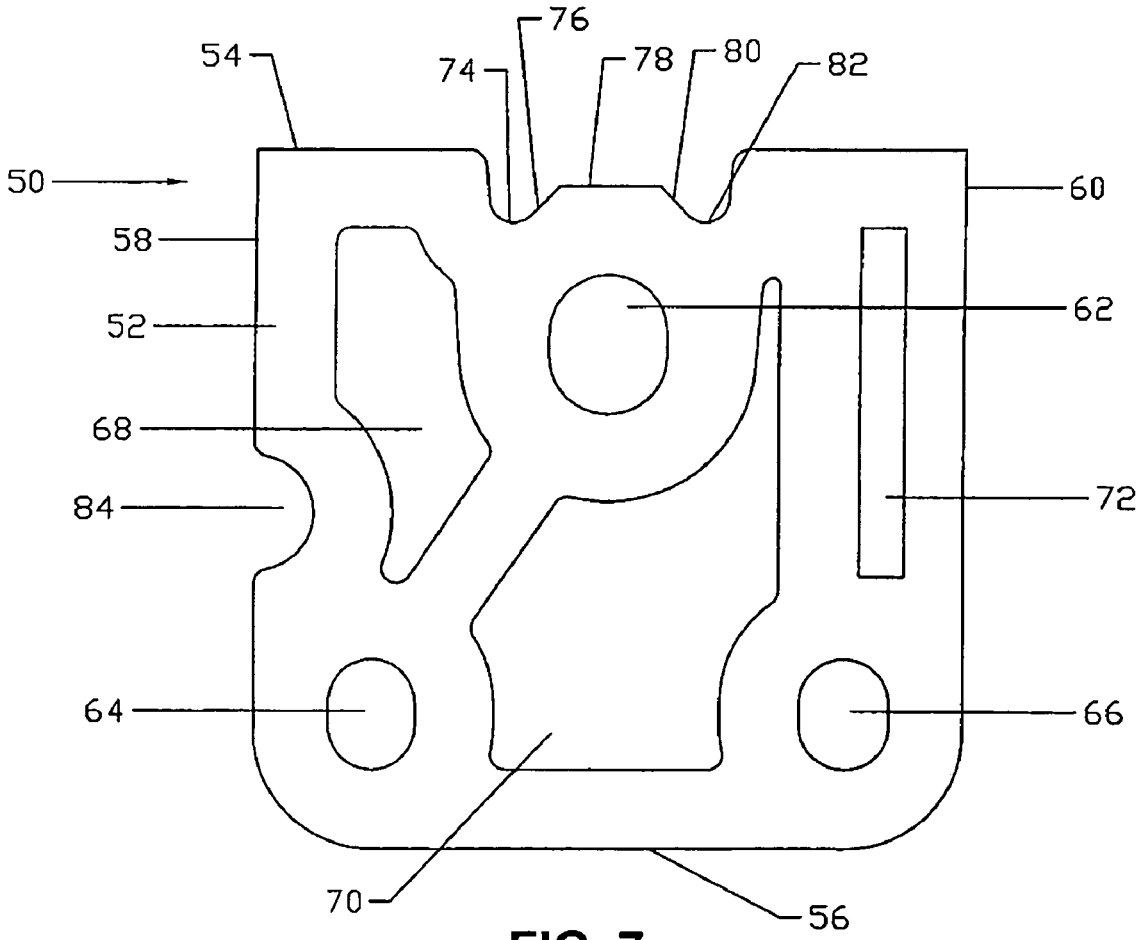
FIG. 7 shows a front view of the concrete lift anchor of FIG. 6.
Figure 8:
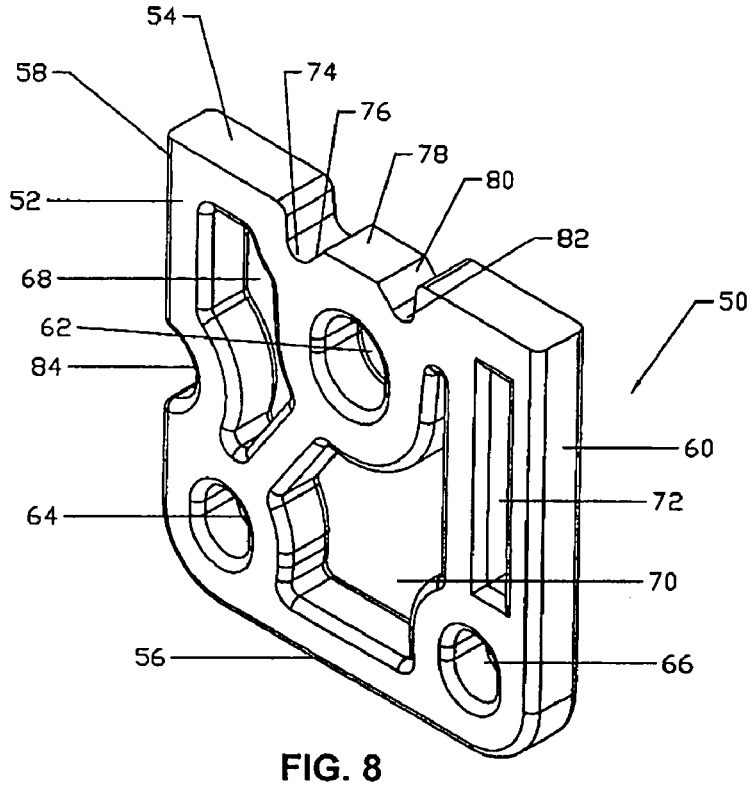
FIG. 8 shows a perspective view of the concrete lift anchor of FIG. 6.

FIG. 5 shows the anchor 10 of the present invention embedded in a concrete form 120. The top 14 of the metal bar 12 is positioned adjacent to the face of the concrete form 120. A void former, suitably made from rubber, is placed around the anchor 10 and covers a portion of the anchor 10, including the first channel 28, platform face 32, second channel 36, and the attachment aperture 22. When the concrete is poured around the anchor 10, the area covered by the void former stays free of concrete, while the rest of the anchor 10, including the passthrough aperture 26, shear plates 102, and wedged shaped foot 48 are encompassed by the concrete. When the concrete form 120 is hardened, the void former is removed and a void recess 122 is formed around a portion of the anchor 10, allowing lifting hardware to be attached to the anchor 10, via the attachment aperture 22 and the first channel 28, platform face 32, and second channel 36. This allows for a lifting attachment to be suitably connected to the concrete anchor 10.

Another embodiment of the concrete anchor is shown in FIGS. 6–9.

The anchor 50 comprises a square shaped bar 52 suitably constructed out of a durable metal such as steel. The anchor 50 is constructed by drop forging or casting as a unitary piece. The bar 52 has a top 54, bottom 56 and first 58 and second 60 sides, an attachment aperture 62, a first 64 and second 66 reinforcement bar aperture, a first 68 and second 70 passthrough apertures, and a shear plate aperture 72.

Suitably, the first and second passthrough apertures 68 and 70 are designed so that the weight of the anchor 50 is reduced by at least 30%. The reinforcement bar apertures 64 and 66 are suitably designed to allow for reinforcement bars to be passed through the apertures 64 and 66 respectively. The shear plate aperture 72 is found on the bar 52 adjacent to the second side 60. The shear plate aperture 72 is designed to receive a shear plate or plates 104. The shear plate 104 is suitably held in place by either by a tack weld or by the use of wedges that are pushed in from opposite sides and locked by driving them in by force.

The top side 54 of the bar 52 further comprises a first channel 74, a first upwardly projecting face 76, a platform face 78, a second upwardly projecting face 80, and a second channel 82. The platform face 78, along with the lifting attachment aperture 62, is suitably designed to allow for the secure attachment of a lifting mechanism for moving and positioning a concrete form in which the concrete lift anchor 50 is embedded. The lifting attachment (such as a hook or other suitable attachment) is suitably connected to the concrete anchor 50 via the attachment aperture 62.

The anchor further comprises a crescent shaped indentation 84 on the first side 58 of the square shaped bar 52. The crescent shaped indentation 84 allows for a reinforcement bar to be positioned within the indentation.

Figure 10:
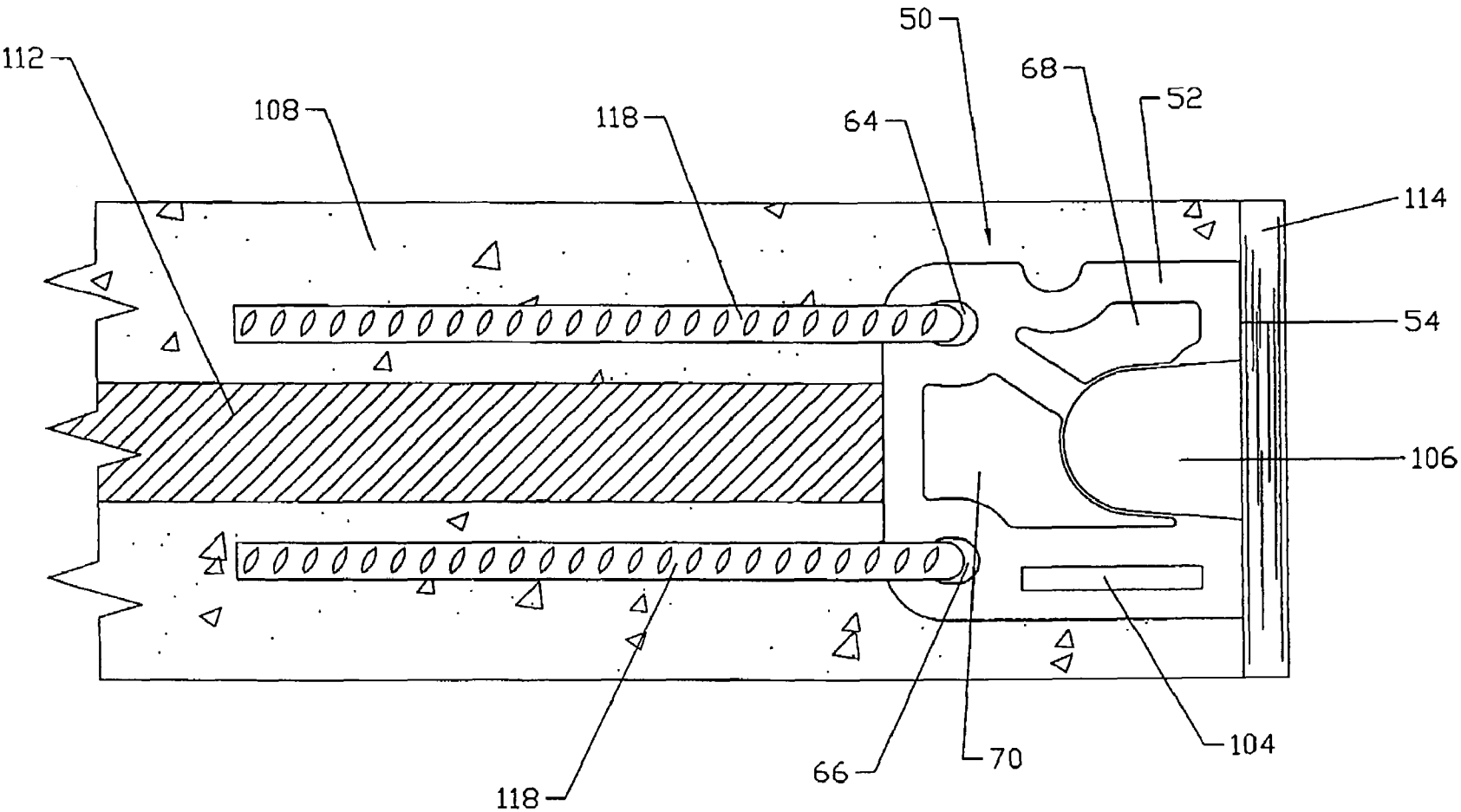
FIG. 10 shows a cut-away side view of the concrete lift anchor of FIG. 6 embedded in a concrete form.

FIG. 10 shows the anchor 50 embedded in a concrete form 108. The anchor 50 is attached to a rubber void former 106 which is attached to a frame 114 which shapes the poured concrete into a desired shaped concrete form 108. The anchor 50 is positioned such that the top face 54 of the bar 52 is adjacent to the frame 114. Reinforcement bars 118 are passed through the reinforcement bar apertures 64 and 66 in the anchor 50 in order to provide more stability to the anchor 50 when the concrete hardens. The void former 106 is positioned onto the anchor 50 so that the void former 106 covers a portion of the anchor 50, including the first channel, platform face, second channel, and the attachment aperture. Insulation 112 can also be positioned within the frame 114. When concrete is poured into the frame 114, the area protected by the void former 106 stays free of concrete, while the remainder of the anchor 50, including the passthrough apertures 68 and 70, shear plate 104, reinforcement bars 118 and insulation 112 are encompassed by the concrete. When the concrete form 108 is hardened, the void former 106 is removed and a void recess is formed around a potion of the anchor 50, allowing lifting hardware to be attached to the anchor 50, via the attachment aperture 62 and the first channel 74, platform face 78, and second channel 82. This allows for a lifting attachment to be suitably connected to the concrete anchor 50.

FIGS. 11–14 illustrate yet another embodiment of the present invention. Much of the structure of the anchor 200 illustrated in FIGS. 11–14 is similar to the anchor 10 described above with reference to FIGS. 1–5, and therefore shares the same reference numerals in the 200 series for those elements and features that correspond to elements and features in the embodiment of FIGS. 1–5. Only those elements and features that are different from the previous embodiments will be described in detail below. For a more complete understanding of the elements and features (and alternatives thereto) of the embodiment illustrated in FIGS. 11–14, reference is hereby made to the discussion of the embodiments above.

As shown in FIGS. 11–14, the anchor 200 includes a rectangular-shaped bar 212 having a top 214, a bottom 216, a front side 501, a back side 502, a first side 218 and a second side 220. The anchor 200 further includes a projection 201 that defines an extending side face 240. The extending side face 240 is wider than the second side 220 of the bar 212 (which has portions above and below the projection 201).

Figure 11:
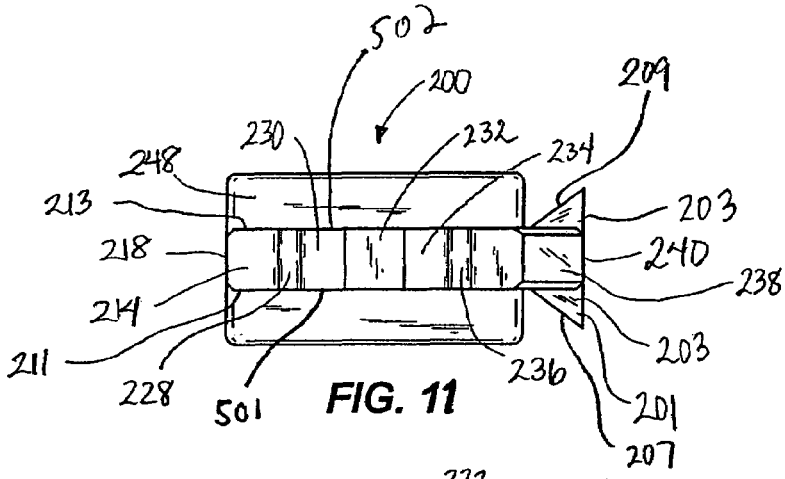
FIG. 11 shows a top view of another embodiment of the concrete lift anchor of the present invention.
Figure 12:
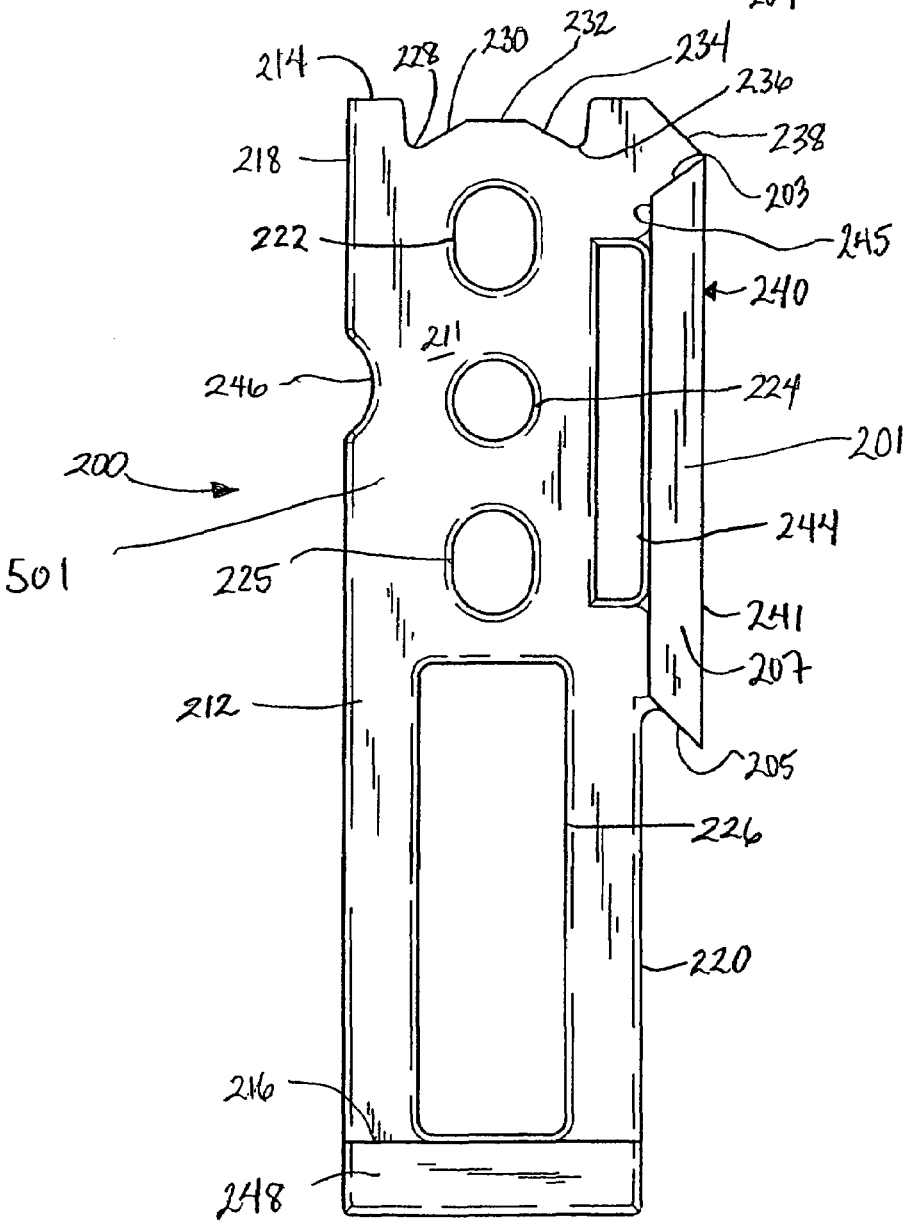
FIG. 12 shows a front view of the concrete lift anchor of FIG. 11.
Figure 13:
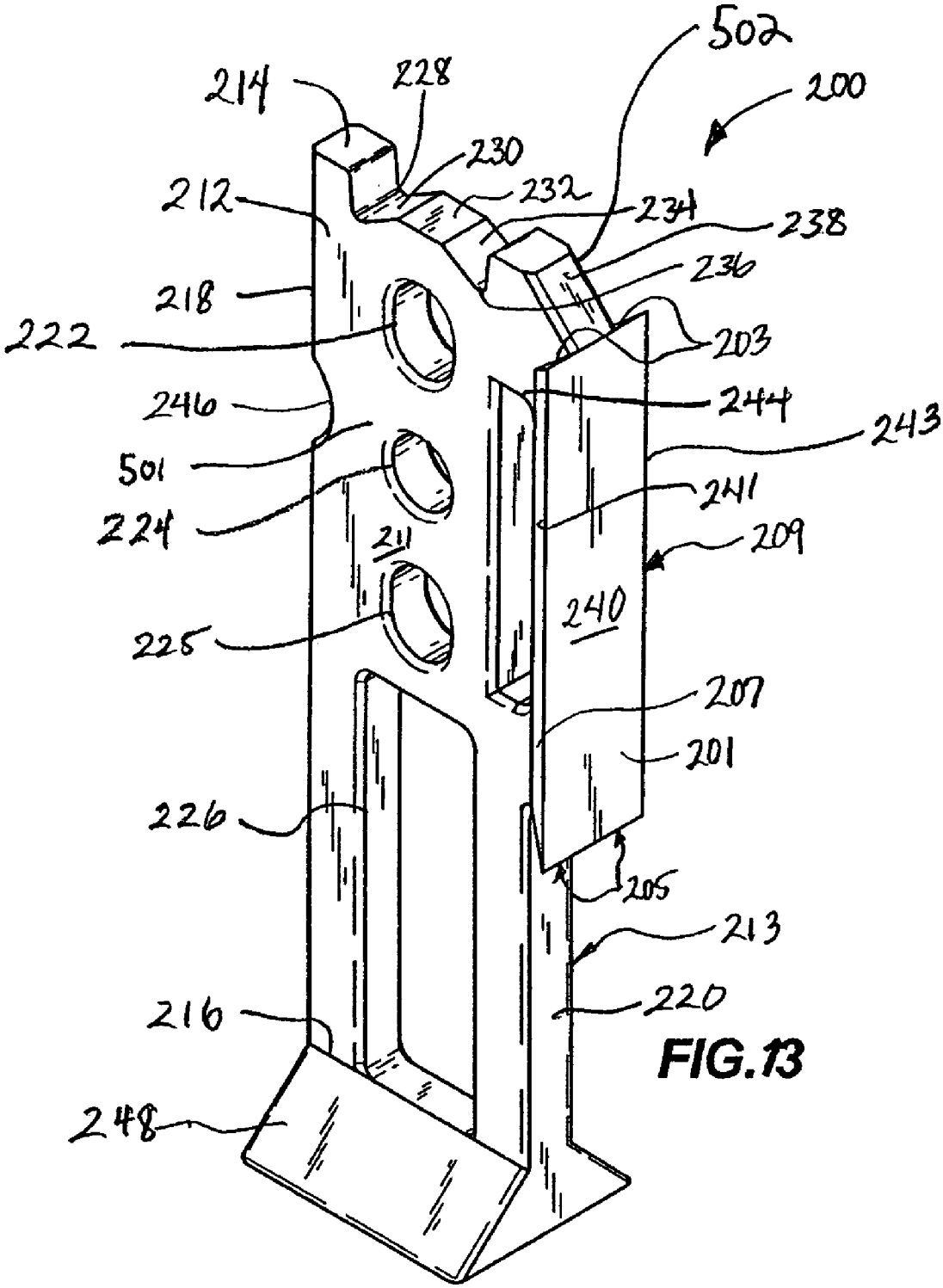
FIG. 13 shows a perspective view of the concrete lift anchor of FIG. 11.

The projection 201 includes two upwardly projecting top faces 203, two downwardly projecting bottom faces 205, a forwardly projecting front face 207 and a rearwardly projecting rear face 209. The two upwardly projecting top faces 203 and the two downwardly projecting bottom faces 205 each have a generally triangular shape, as best shown in FIG. 11. The two upwardly projecting top faces 203 and the two downwardly projecting bottom faces 205 of the projection 201 can instead form one upwardly projecting top face 203 and one downwardly projecting bottom face 205, respectively. Alternatively, the projection 201 can include a plurality of upwardly projecting top faces 203 and a plurality of downwardly projecting bottom faces 205.

The forwardly projecting front face 207 extends from a front surface 211 of the bar 212 adjacent a shear plate aperture 244 to a front edge 241 of the extending side face 240. The rearwardly projecting rear face 209 extends from a rear surface 213 of the bar 212 adjacent the shear plate aperture 244 to a rear edge 243 of the extending side face 240.

In some embodiments of the present invention, the projection 201 can be integrally formed with the bar 212. In other embodiments, the projection 201 can include an aperture dimensioned to receive at least a portion of the second side 220 of the bar 212. In such embodiments, the second side 220 of the bar 212 can be press-fit into engagement with the aperture, can be secured by a variety of fasteners (e.g., screws, nails, bolts, staples, and the like), can be welded (e.g., tack welded) or can be adhered by a variety of adhesives know to those of ordinary skill in the art.

In still other embodiments, the second side 220 of the bar 212 can include an aperture dimensioned to receive at least a portion of the projection 201, in which the projection 201 is secured within the aperture of the second side 220 of the bar 212 by any of the types of engagement described above. In such embodiments, the projection 201 can have a generally trapezoidal cross-sectional shape, with one upwardly projecting top face 203, one downwardly projecting bottom face 205, and a second extending side face 245 (illustrated in FIG. 12 by way of example only) positioned adjacent the shear plate aperture 244 when the projection 201 is engaged with the aperture of the second side 220 of the bar 212. In some embodiments, the second extending side face 245 of the projection 201 can also define the shear plate aperture 244. In other embodiments, the second extending side face 245 can be positioned adjacent the shear plate aperture 244 of the bar 212.

Figure 14:
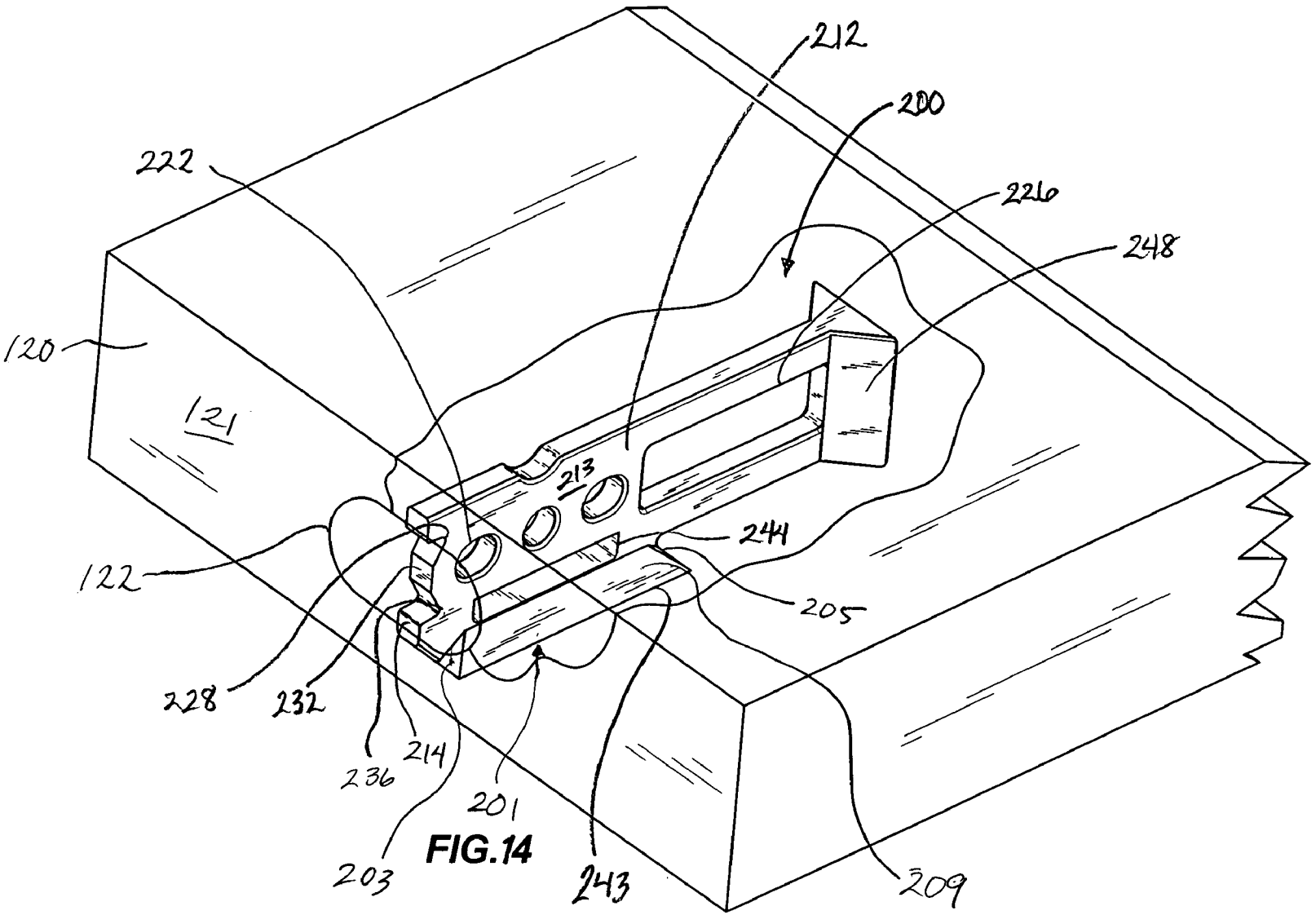
FIG. 14 shows a cut-away perspective view of the concrete lift anchor of FIG. 11 embedded in a concrete form.

FIG. 14 illustrates the anchor 200 embedded in a concrete form 120. The top 214 of the bar 212 is positioned adjacent to a front face 121 of the concrete form 120. A void former (not shown), suitably made from rubber, can be placed around the anchor 200 to cover a portion of the anchor 200, as explained above with respect to FIG. 5. When concrete is poured around the anchor 200, the area covered by the void former remains free of concrete, while the rest of the anchor 200, including a passthrough aperture 226, a wedged shaped foot 248 and the projection 201, are covered by the concrete. When the concrete form 120 is hardened, the void former can be removed such that a void recess 122 is formed around a portion of the anchor 200, allowing lifting hardware to be attached to the anchor 200, via an attachment aperture 222, a first channel 228, platform face 232, and a second channel 236. This allows for a lifting attachment to be suitably connected to the concrete anchor 200.

Figure 4:
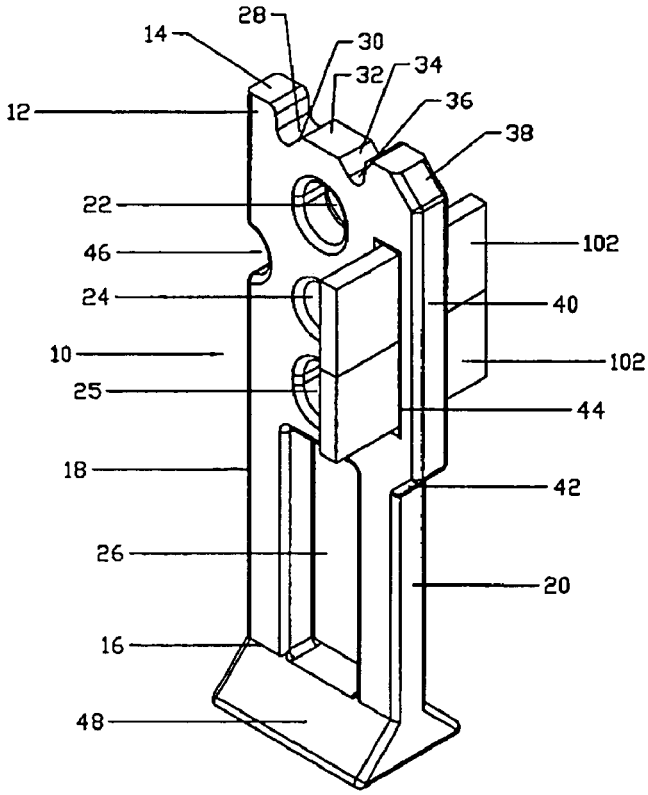
FIG. 4 shows a perspective view of the concrete lift anchor of FIG. 1 with shear plates positioned within a shear plate aperture.

Although not illustrated in FIGS. 11–14, in some embodiments of the present invention, the anchor 200 can further include at least one shear plate 102 positioned in the shear plate aperture 244, as illustrated in FIGS. 4 and 5 and described above. In other embodiments, the anchor 200 does not include at least one shear plate 102 positioned in the shear plate aperture 244, and the shear plate aperture 244 in such embodiments allows concrete to pass through the aperture 244, similar to the passthrough aperture 226. As a result, the shear plate aperture 244 can alternatively comprise a passthrough aperture.

FIGS. 15–19 illustrate yet another embodiment of the present invention. Much of the structure of the anchor 250 illustrated in FIGS. 15–19 is similar to the anchor 50 described above with reference to FIGS. 6–10, and therefore shares the same reference numerals in the 200 series for those elements and features that correspond to elements and features in the embodiment of FIGS. 6–10. Only those elements and features that are different from the previous embodiments will be described in detail below. For a more complete understanding of the elements and features (and alternatives thereto) of the embodiment illustrated in FIGS. 15–19, reference is hereby made to the discussion of the embodiments above.

As shown in FIGS. 15–19, the anchor 250 includes a square shaped bar 252 having a top 254, a bottom 256, a first side 258 and a second side 260. The anchor 250 further includes a projection 251. The projection 251 includes a first side face 275 that partially defines a shear plate aperture 272, a second side face 277 flush with the second side 260 of the bar 252 (and at least partially defining the second side 260 of the bar 252), two upwardly projecting top faces 253, two downwardly projecting bottom faces 255, a forwardly projecting front face 257 and a rearwardly projecting rear face 259. The first side face 275 of the projection 251 has generally the same width as the second side 260 of the bar 252, and the second side face 277 of the projection 251 is generally wider than the first side face 275.

Figure 15:
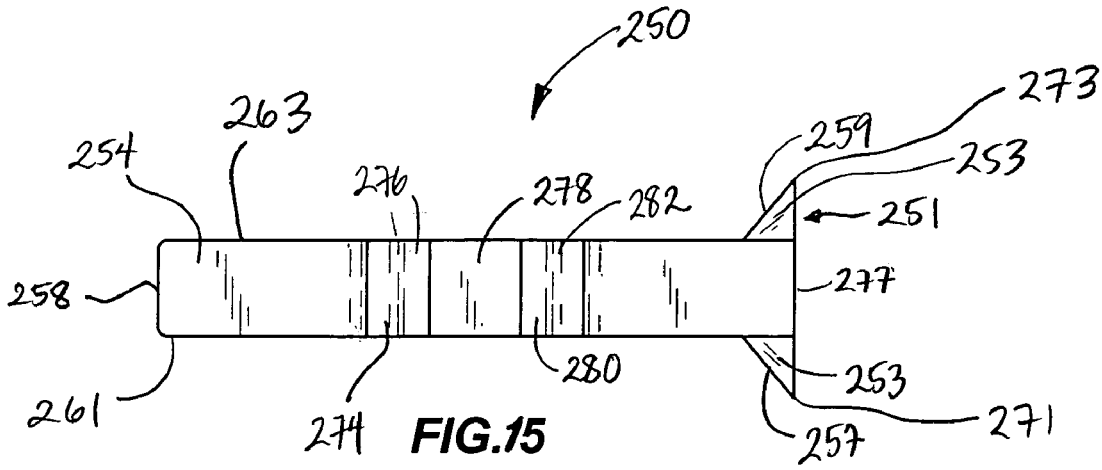
FIG. 15 shows a top view of another embodiment of the concrete lift anchor of the present invention.
Figure 16:
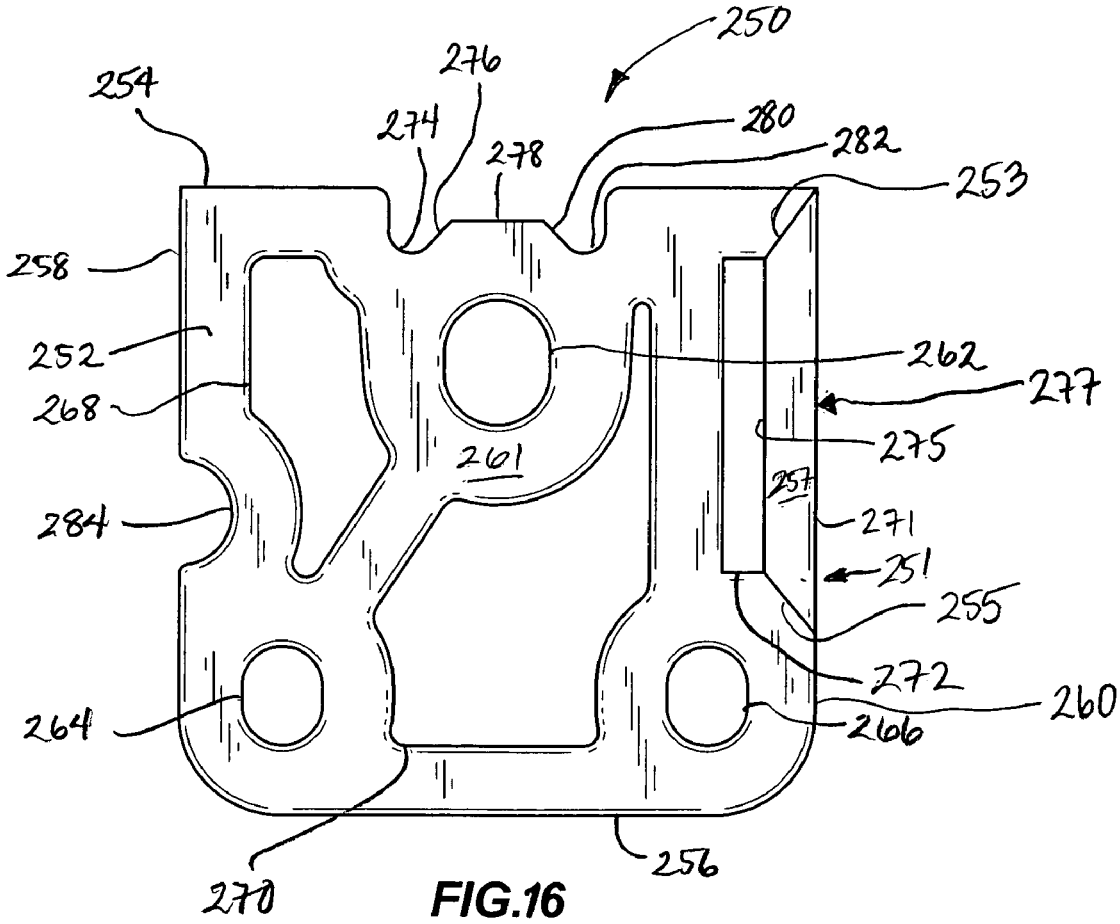
FIG. 16 shows a front view of the concrete lift anchor of FIG. 15.
Figure 17:
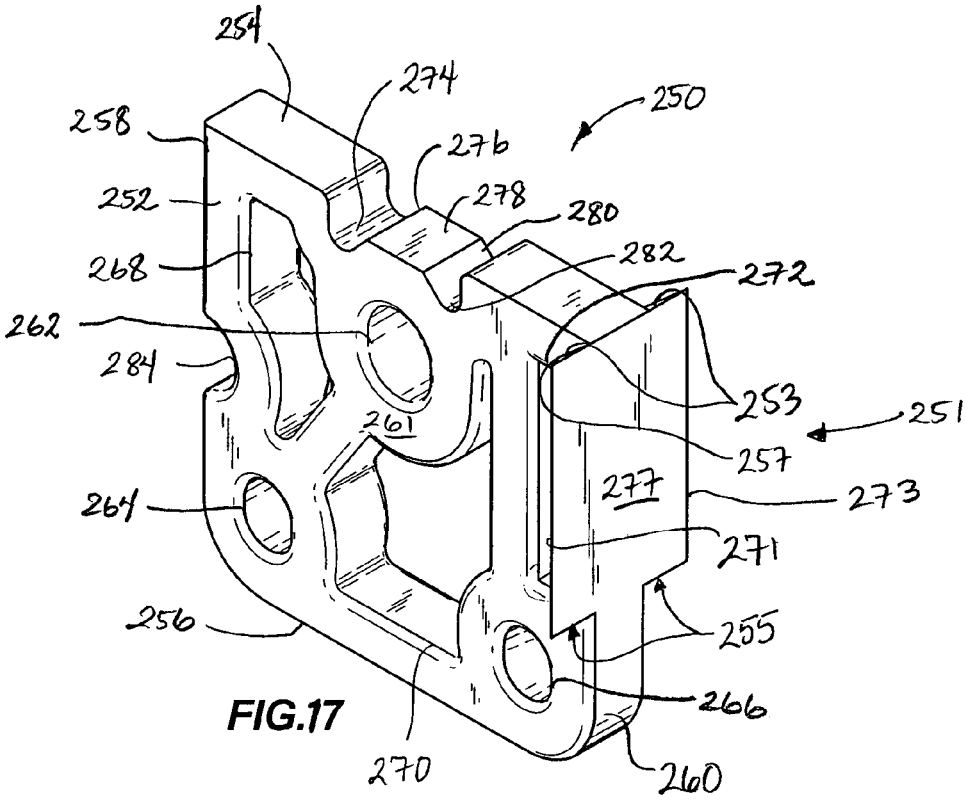
FIG. 17 shows a front perspective view of the concrete lift anchor of FIG. 15.
Figure 18:
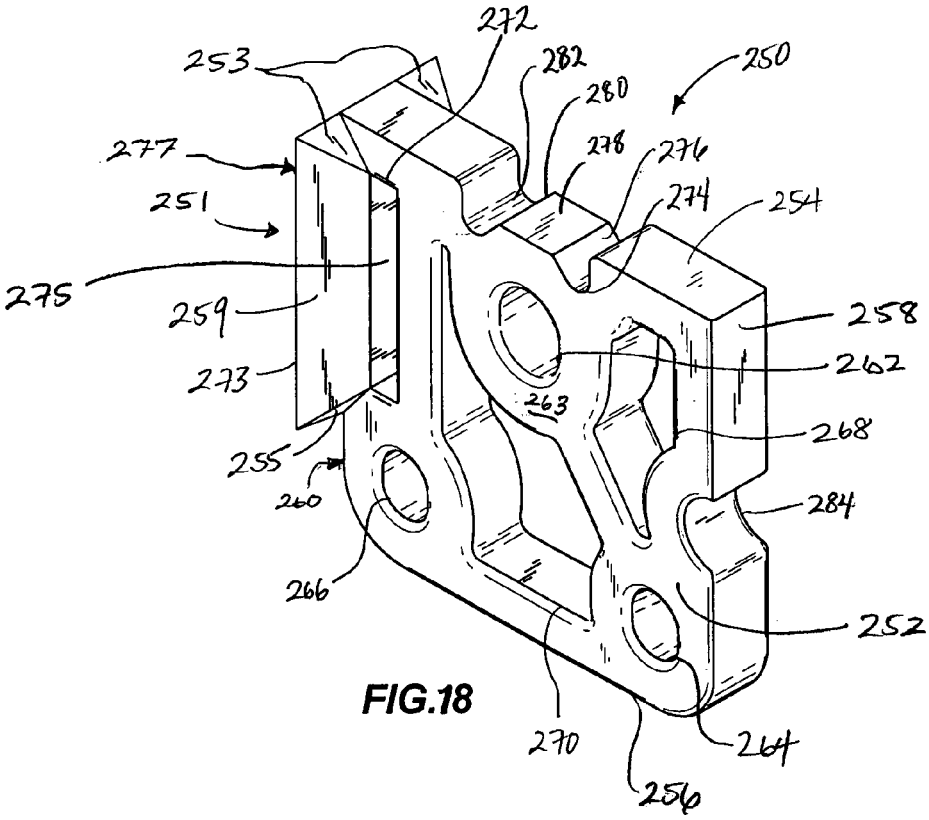
FIG. 18 shows a rear perspective view of the concrete lift anchor of FIG. 15.

The two upwardly projecting top faces 253 and the two downwardly projecting bottom faces 255 each have a generally triangular shape, as best shown in FIG. 15. The two upwardly projecting top faces 253 and the two downwardly projecting bottom faces 255 of the projection 251 can instead form one upwardly projecting top face 253 having a generally trapezoidal shape and one downwardly projecting bottom face 255 having a generally trapezoidal shape, respectively, as discussed in greater detail below. Alternatively, the projection 251 can include a plurality of upwardly projecting top faces 253 and a plurality of downwardly projecting bottom faces 255.

The forwardly projecting front face 257 extends from a front face 261 of the bar 252 adjacent the shear plate aperture 272 to a front edge 271 of the second side face 277 of the projection. The rearwardly projecting rear face 259 extends from a rear surface 263 of the bar 252 adjacent the shear plate aperture 272 to a rear edge 273 of the second side face 277.

In some embodiments of the present invention, the projection 251 can be integrally formed with the bar 252, such that the first side face 275 of the projection 251 partially defines the shear plate aperture 272, as shown in the embodiment illustrated in FIGS. 15–19 and described above. In other embodiments, the projection 251 can include an aperture dimensioned to receive at least a portion of the second side 260 of the bar 252. In such embodiments, the second side 260 of the bar 252 can engage the projection 251 in any of the manners described above. In still other embodiments, the second side 260 of the bar 252 can include an aperture dimensioned to receive at least a portion of the projection 251, in which the projection 251 is secured within the aperture of the second side 260 of the bar 252 by any of the types of engagement described above. In such embodiments, the projection 251 can have a generally trapezoidal cross-sectional shape, with one upwardly projecting top face 203 and one downwardly projecting bottom face 205.

Figure 19:
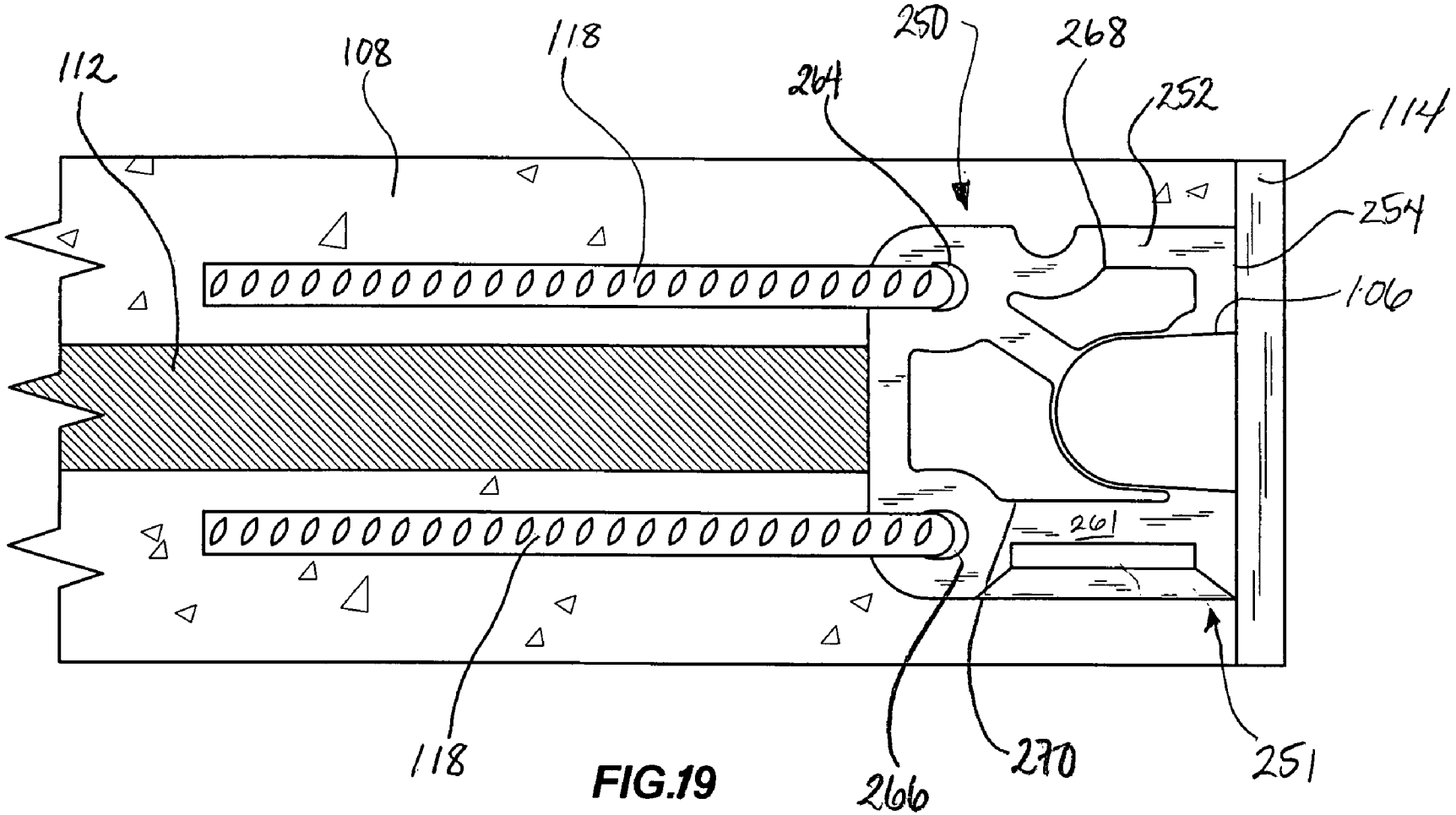
FIG. 19 shows a cut-away side view of the concrete lift anchor of FIG. 15 embedded in a concrete form.

FIG. 19 illustrates the anchor 250 embedded in a concrete form 108. The anchor 250 is attached to a rubber void former 106 which is attached to a frame 114 which shapes the poured concrete into a desired shaped concrete form 108. The anchor 250 is positioned such that the top 254 of the bar 252 is adjacent to the frame 114. Reinforcement bars 118 are passed through reinforcement bar apertures 264 and 266 in the anchor 250 in order to provide more stability to the anchor 250 when the concrete hardens. The void former 106 is positioned over the anchor 250 so that the void former 106 covers a portion of the anchor 250, as described above with respect to FIG. 10. Insulation 112 can also be positioned within the frame 114. When concrete is poured into the frame 114, the area protected by the void former 106 remains free of concrete, while the remainder of the anchor 250, including passthrough apertures 268 and 270, the projection 251, the reinforcement bars 118 and the insulation 112, are enveloped by the concrete. When the concrete form 108 is hardened, the void former 106 is removed and a void recess is formed around a portion of the anchor 250, allowing lifting hardware to be attached to the anchor 250, via an attachment aperture 262, a first channel 274, a platform face 278, and a second channel 282. This allows for a lifting attachment to be suitably connected to the concrete anchor 250.

Figure 9:
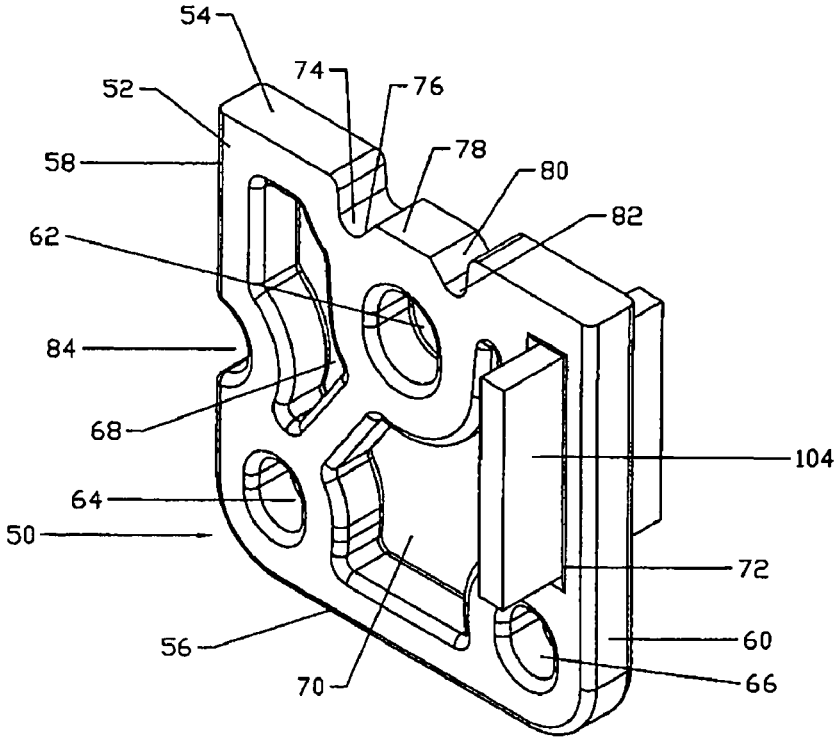
FIG. 9 shows a perspective view of the concrete lift anchor of FIG. 6 with a shear plate positioned within a shear plate aperture.

Although not illustrated in FIGS. 15–19, in some embodiments of the present invention, the anchor 250 can further include at least one shear plate 104 positioned in the shear plate aperture 272, as illustrated in FIGS. 9 and 10 and described above. In other embodiments, the anchor 250 does not include at least one shear plate 104 positioned in the shear plate aperture 272, and the shear plate aperture 272 in such embodiments allows concrete to pass through the aperture 272, similar to the passthrough apertures 268 and 270. As a result, the shear plate aperture 272 can alternatively comprise a passthrough aperture.

The invention claimed is:

1. A concrete anchor comprising:

a bar having a top, a bottom, a front side, a back side, and first and second sides, at least one attachment aperture, at least one reinforcement bar aperture, at least one passthrough aperture, and a wedged shaped foot positioned adjacent the bottom of the bar; and a projection, the projection being positioned adjacent the second side of the bar and extending away from sideway direction from the second side comprising an upwardly projecting top face, a downwardly projecting bottom face, a forwardly projecting front face that extends away in a frontward direction from the front side of the bar and a rearwardly projecting rear face that extends away in a rearward direction from the back side of the bar.

2. The concrete anchor of claim 1, wherein the bar and the projection are integrally formed.

3. The concrete anchor of claim 1, wherein the upwardly projecting top face is one of two upwardly projecting top faces.

4. The concrete anchor of claim 1, wherein the downwardly projecting bottom face is one of two downwardly projecting bottom faces.

5. The concrete anchor of claim 1, wherein the top of the bar comprises a first channel, a platform face, and a second channel.

6. The concrete anchor of claim 1, wherein the second side of the bar further comprises a downwardly projecting side face, and an extending side face.

7. The concrete anchor of claim 1, further comprising a crescent shaped indentation defined in the first side of the bar.

8. The concrete anchor of claim 1, further comprising a shear plate aperture defined in the bar and positioned adjacent the second side of the bar.

9. The concrete anchor of claim 1, wherein the projection includes a first side face and a second side face, the first side face at least partially defining at least one of a shear plate aperture and a passthrough aperture, and the second side face at least partially defining the second side of the bar.

10. The concrete anchor of claim 1, wherein the at least one passthrough aperture is designed so that the weight of the anchor is reduced by at least 30% from the weight of the anchor without the passthrough aperture.

11. The concrete anchor of claim 1 wherein the first and second sides of the bar each defining a width, and the projection further has extending side faces defining a width, wherein the width of the projection is greater than the width of the first and second sides of the bar.

12. The concrete anchor of claim 1 wherein the bar further has a slanted downwardly projecting side face and the projection further has an extending side face; and wherein the slanted downwardly projecting side face projects downward at an angle from the top of the bar to the extending side face.

13. The concrete anchor of claim 1 wherein the bar further has a shear plate aperture adjacent to the second side of the bar; and wherein the projection is positioned adjacent to the shear plate aperture of the bar.

14. The concrete anchor of claim 5, wherein the top of the bar further comprises a first upwardly projecting face and a second upwardly projecting face.

15. A concrete anchor comprising:

a rectangular shaped bar having a top, a bottom, a front side, a back side, a first side, and a second side, at least one attachment aperture, at least one reinforcement bar aperture, at least one passthrough aperture, and a wedged shaped foot positioned adjacent the bottom of the rectangular shaped bar; and a projection positioned adjacent the second side of the bar and extending away from sideway direction from the second side the projection comprising an upwardly projecting top face, a downwardly projecting bottom face, a forwardly projecting front face that extends away in a frontward direction from the front side of the bar, and a rearwardly projecting rear face that extends away in a rearward direction from the back side of the bar.

16. The concrete anchor of claim 15, wherein the rectangular shaped bar is integrally formed with the projection.

17. The concrete anchor of claim 15, wherein the second side of the rectangular shaped bar further comprises a downwardly projecting side face and an extending side face, the extending side face forming at least a portion of the projection.

18. The concrete anchor of claim 15, further comprising a shear plate aperture defined in the bar and positioned adjacent the second side of the bar.

19. The concrete anchor of claim 17, further comprising a shear plate aperture defined in the bar and positioned adjacent the extending side face.

20. The concrete anchor of claim 15, further comprising a crescent shaped indentation defined in the first side of the rectangular shaped bar.

21. The concrete anchor of claim 15, wherein the top of the rectangular shaped bar includes a first channel, a platform face and a second channel to allow engagement of the rectangular shaped bar with lifting hardware.

22. The concrete anchor of claim 15, wherein the at least one passthrough aperture is designed so that the weight of the anchor is reduced by at least 30% from the weight of the anchor without the passthrough aperture.

* * * * *